US010155641B2

(12) United States Patent
Burri et al.

(10) Patent No.: US 10,155,641 B2
(45) Date of Patent: Dec. 18, 2018

(54) ESCALATOR OR MOVING WALKWAY WITH AT LEAST ONE ACCESS MODULE

(71) Applicant: INVENTIO AG, Hergiswil (CH)

(72) Inventors: Jürg Burri, Hirschthal (CH); Michael Matheisl, Vösendorf (AT)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 15/747,540

(22) PCT Filed: Jul. 15, 2016

(86) PCT No.: PCT/EP2016/066959

§ 371 (c)(1),
(2) Date: Jan. 25, 2018

(87) PCT Pub. No.: WO2017/016905

PCT Pub. Date: Feb. 2, 2017

(65) Prior Publication Data

US 2018/0215589 A1 Aug. 2, 2018

(30) Foreign Application Priority Data

Jul. 28, 2015 (EP) ..... 15178552

(51) Int. Cl.
*B66B 23/00* (2006.01)
*B66B 21/04* (2006.01)
*B66B 21/10* (2006.01)

(52) U.S. Cl.
CPC ..... *B66B 23/00* (2013.01); *B66B 21/04* (2013.01); *B66B 21/10* (2013.01)

(58) Field of Classification Search
CPC ..... B66B 21/02; B66B 21/00; B66B 23/00; B66B 23/026
USPC ..... 198/321, 326
See application file for complete search history.

(56) References Cited

U.S. PATENT DOCUMENTS 4,674,619 A * 6/1987 Nakazawa ..... B66B 23/02 198/331
5,348,131 A * 9/1994 Yamaguchi ..... B66B 23/02 198/321

FOREIGN PATENT DOCUMENTS

| | | | |
|---|---|---|---|
| CN | 201 952 093 | 8/2011 | |
| EP | 1 777 192 B1 | 3/2010 | |
| GB | 2 205 803 | 12/1988 | |
| GB | 2244464 | * 12/1991 | ..... B66B 23/02 |

(Continued)

OTHER PUBLICATIONS

International Search Report for International Application No. PCT/EP2016/066959 dated Oct. 20, 2016.

*Primary Examiner* — James R Bidwell
(74) *Attorney, Agent, or Firm* — Knobbe Martens Olson & Bear LLP

(57) ABSTRACT

An escalator or moving walkway comprises two access areas. The escalator or the moving walkway comprises components generating thermal losses that are arranged in at least one of the access areas in a component room. The escalator or the moving walkway comprises at least one walkable access module, which is arranged adjacent to the component compartment. The access module comprises a cavity, wherein at least one opening exists between the component compartment and the cavity, through which the thermal energy of the components generating thermal losses can be transferred from the component compartment to the cavity.

19 Claims, 2 Drawing Sheets

(56) References Cited

FOREIGN PATENT DOCUMENTS

JP 2011 157144 8/2011

* cited by examiner

ESCALATOR OR MOVING WALKWAY WITH AT LEAST ONE ACCESS MODULE

TECHNICAL FIELD

The invention relates to an escalator or a moving walkway comprising at least one access module.

DESCRIPTION OF RELATED ART

GB 2 205 803 A discloses a moving walkway comprising two access areas. They are used to enter or respectively exit the revolving conveyor belt located between the entrance areas. Since the moving walkway is arranged on level ground and not in a pit, users must reach the higher level of the conveyor belt from a walkable ramp that is adjacently arranged. The intended conveyor belt is an elastic belt. The drive components are arranged in one of the access areas below a walkable cover. The drive components comprise a drive gearbox and an electric motor. Furthermore, control components such as switches, relays, motor contactors, frequency converters, transformers, as well as circuit boards with processors and data storage units can be arranged in the entrance area below the walkable cover.

The aforementioned arrangement of drive components and control components in the access area below the walkable cover has the advantage that all electric components are arranged closely together. This minimizes the required wiring. Furthermore, troubleshooting in the event of faults relating to the electric components is much easier because all relevant components such as the drive motor, the controller, frequency converter, transformer, relays, motor contactors and the like are immediately accessible by opening the walkable cover.

A disadvantage of this arrangement is, however, the high density of components generating thermal losses such as the drive motor, the controller, the frequency converter, the transformer, the relays, and the motor contactors. This may cause the walkable cover to overheat, causing concern for the users of the escalator or the moving walkway. Furthermore, the high density may cause heat to build up, which may significantly shorten the useful life of the electric and mechanic components of the escalator or the moving walkway.

The revolving conveyor belt is rerouted in the access areas. The rerouting may lead to operational noise, in particular in conveyor belts with pallets. The drive motor, the transformer, and the contactors may cause significant operational noise as well so that the space below the walkable cover that houses these components must be sound-absorbing. Generally, sound-absorbing materials are heat-absorbing as well, so that the danger of a heat buildup becomes even greater.

SUMMARY

The task of this invention is therefore to prevent heat buildup below the walkable cover, even if components generating thermal losses are tightly arranged in this area.

This task is solved by an escalator or a moving walkway with two access areas from which the escalator or the moving walkway can be accessed or exited. The escalator or the moving walkway comprises components generating thermal losses that are arranged in at least one of the access areas in a component space below a walkable cover. Furthermore, the escalator or the movable walkway comprises at least one walkable access module which is arranged adjacent to the component compartment. The walkable access module comprises a walkable area and a cavity. Between the component compartment and the cavity, there is at least one opening through which the heat energy of the components generating thermal losses can move from the component compartment to the cavity.

Due to this configuration, the component compartment can be kept very small. This makes it possible, for example, to build the moving walkways very flat and compact so that they do not require a pit. The flat design of the moving walkway also facilitates a short access module without making its ramp too steep, for example, and impairing users who have difficulty walking. The heat energy of the components generating thermal losses does not impact the components in the component compartment, but is transferred to the cavity of the access module. By using the cavity of the access ramp, a cooling system is created which is separate from the environment which facilitates an efficient thermal energy transfer from the component compartment without polluting the surrounding area for example with the noise of a cooling blower, which blows the warm air from the component compartment into the environment and kicks up dust and dirt. Furthermore, it is essentially always the same air that is circulated so that no dirt enters the component compartment by the suction of cooling air.

It should still be mentioned that the cavity is delimited from the environment from all sides, but that the delimiting components and structures do not have to be all the components of the walkable access module. If, for example, a pit is present, the access module can essentially be a walkable area with a structure that sufficiently supports the walkable area against the ground. The remaining structures delimiting the cavity may be three walls and the bottom of the pit as well as one end wall of the bearing structure of the moving walkway or the escalator that separate the component compartment from the cavity. Of course, the walkable access module may have walls all around that enclose the entire cavity and delimit it from the surrounding area and the ground. Variations between these two embodiments described are possible as well.

To dissipate the thermal energy dissipated into the cavity, the walkable area of the access module may comprise heat-conducting material, wherein the walkable area is preferably the ceiling of the cavity. The heat-conducting material can be, for example, all metals, whereas the walkable area is preferably made from aluminum or corrosion-resistant steel. The dissipation of the thermal energy through the walkable area is particularly advantageous because its large area is exposed to the surrounding area and its visible and/or walkable surface therefore only has a slightly higher temperature than the area surrounding the access module. This type of thermal energy dissipation to the surrounding area contributes significantly to safety as well because the slightly higher temperature causes the walkable area to dry quickly after having been cleaned or prevents it from icing over if located outside.

The thermal energy of the components generating thermal losses can be transferred from the component compartment to the cavity in various ways.

In a first embodiment of the invention, at least some of the components generating thermal losses may comprise cooling elements. These cooling elements may be arranged so that they pass through at least one opening and protrude into the cavity.

Preferably, no heated air from the cavity should reach the component room in this first embodiment. To achieve this, the cross section of the at least one opening may be adapted to the cross section of the cooling elements so that the at least one opening is closed by the cooling elements that pass through it.

To assist with the cooling of the hot cooling elements, the air in the cavity serving as a transport medium of the thermal energy between the cooling elements and the walkable area may be moved and/or circulated by means of at least one blower arranged in the access module.

In a second embodiment of the invention, an air exchange may take place between the component compartment and the cavity such that the air heated by the components generating thermal losses flows from the component compartment through at least one opening into the cavity, and cooler air from the cavity flows from the cavity through at least another opening into the component compartment.

Depending on the configuration of the cavity, the thermal energy input from the components generating thermal losses can create an airflow without further means through which the heated air reaches the walkable area and can cool off along this area (convection). This air flow can be supported, for example, by other means, such as a blower and/or a ventilator.

Since significant flow resistances may be present in the component compartment and the cavity due to shapes that obstruct the flow of air, the air flowing through the opening is preferably conveyed or respectively moved by means of at least one blower or respectively one ventilator arranged in the access module.

The air flowing through the opening can, of course, be conveyed or respectively moved by means of at least one blower arranged in the access area below the movable cover.

The components generating thermal losses generally comprise a frequency converter or an inverter. Some of these frequency converters or inverters have a permanently installed blower of their own. If the frequency converter or the inverter is suitably situated in relation to the opening, the air flowing through the opening can be conveyed or respectively moved by means of a blower arranged in the frequency converter or inverter.

With additional installations in the cavity of the access module, the heated air can be appropriately directed to the walkable area of the access module. Such an installation may, for example, be at least one flow baffle.

At least a section of the flat extension of at least one flow baffle may be arranged at a parallel distance to the walkable area. The air warmed or heated by the components generating thermal losses then flows between a bottom side of the movable area and the flow baffle and transfers its thermal energy to the walkable area.

Of course, the flat extension of at least one flow baffle may also be arranged vertical to the walkable area. These vertically arranged flow baffles can structurally reinforce the walkable area or even support it against the bottom of the escalator or the moving walkway.

Of course, the embodiments described above may be combined with each other as well.

The at least one walkable access module may be designed as a ramp or stairs wherein the ramp configuration is preferable.

Existing escalators or moving walkways can be retrofitted or respectively modernized with this cooling system according to the invention. To do so, the existing escalator or the existing moving walkway must be provided with at least one walkable access module that is adjacent to a component compartment of the existing escalator or the existing moving walkway. This walkable access module comprises a walkable area and a cavity as well. Furthermore, an opening must be created between the component compartment and the cavity through which the heat energy from the components generating thermal losses can move from the component compartment to the cavity.

BRIEF DESCRIPTION OF THE DRAWINGS

Preferred exemplary embodiments of the invention are explained in more detail in the description below on the basis of the attached drawings in which corresponding elements are denoted by the same reference numbers. The following is shown.

DETAILED DESCRIPTION

Figure 1:
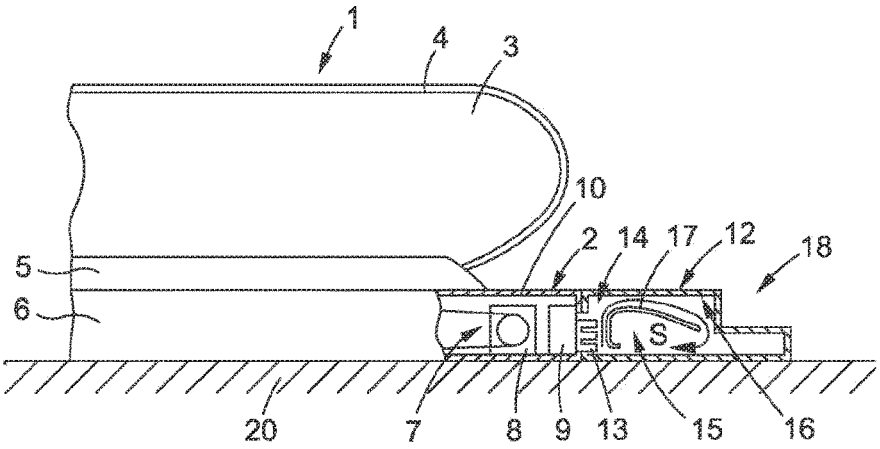
FIG. 1: A first embodiment is schematically illustrated in a partially cut layout part of an escalator arranged on level ground with a component compartment and with a walkable access module, which is arranged adjacent to the component compartment.

FIG. 1 shows, schematically, a first embodiment of an access area 2 in a partially cut layout part of a moving walkway 1 arranged on level ground 20. The moving walkway 1 can be entered and exited from the access area 2. Furthermore, the moving walkway 1 comprises two balustrades 3 (only one visible), wherein a revolving hand rail 4 is arranged on each balustrade 3. The balustrades 3 are each affixed to a bearing structure 6 of the moving walkway 1 by means of a balustrade base 5. This bearing structure 6 also comprises a component compartment 7 in which the components generating thermal losses 8, 9 such as a drive motor 8, a controller 9, and in particular a frequency converter or inverter (integrated in the box of the controller 9) are arranged below a walkable cover 10. Furthermore, the moving walkway 1 comprises a walkable access module 18, which is arranged on the floor 20 adjacent to the component compartment 7.

The other end of the moving walkway 1 is essentially built the same wherein there, instead of the drive motor 8, a clamping device or respectively a sprocket group for a pallet band driven by the drive motor 8 (not shown) can be arranged in the component compartment 7. Components generating thermal losses 9 such as, for example, a redundant controller 9 may, of course, be arranged there as well, as it is disclosed, for example, in EP 1 777 192 B1. At this end as well, the moving walkway 1 may have a walkable access module 18, which is adjacently arranged to the component compartment 7.

The access module 18 essentially comprises a walkable area 12 or respectively a floor cover 12 and a cavity 15, whereas the walkable area 12 is configured in the form of stairs in the present embodiment. At least part of the components generating thermal losses 8, 9 arranged in the component compartment 7 comprise cooling elements 13.

Between the component compartment 7 and the cavity 15, there is at least one opening 14 through which the heat energy of the components generating thermal losses 8, 9 can move from the component compartment 7 to the cavity 15. The at least one opening 14 can be a bore, a slot, a recess, a cutout, etc. The thermal energy is guided through the opening 14 by means of the cooling elements 13 because they are arranged such that they pass through the opening 14 and protrude into the cavity 15.

So that no air heated by the cooling elements 13 in the cavity 15 can flow into the component compartment 7, the cross section of the at least one opening 14 is preferably adapted to the cross section of the cooling elements 13 so that the at least one opening 14 is closed by the cooling elements 13 that pass through it.

Since the walkable area 12, as a component of the cavity 15, ends upward relative to the direction of gravity and therefore forms the ceiling of the cavity 15, the walkable area 12 of the access module 18 is preferably made from heat-conducting material. The air heated by the cooling elements 13 raises to the bottom side 16 of the walkable area 12 and can cool off there. This can create a circular air flow S. To support this circular air flow S, at least one flow baffle 17 can be arranged in the cavity 15. At least a section of the flat extension of at least one flow baffle 17 shown in FIG. 1 may be arranged at a parallel distance to the walkable area 12.

Figure 2:
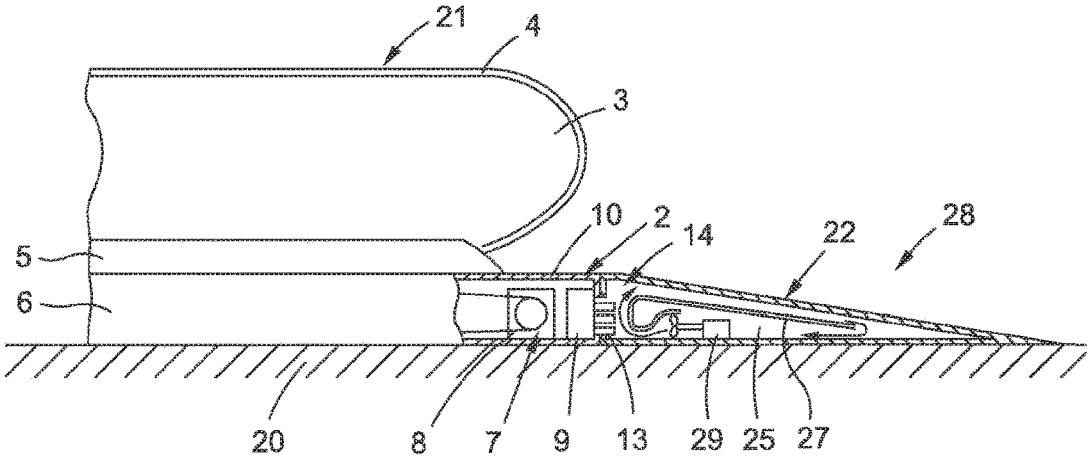
FIG. 2: A second embodiment is schematically illustrated in a partially cut layout part of an escalator arranged on level ground with a component compartment and with a walkable access module, which is arranged adjacent to the component compartment.

FIG. 2 also shows a moving walkway 21 arranged on level ground 20 with a component compartment 7 and with a walkable access module 28, which is arranged adjacent to the component compartment 7. With the exception of the access module 28, the moving walkway 21 shown in FIG. 1 is designed identically with the moving walkway 1 shown, which is why the same reference numbers are used for the same parts.

In FIG. 2, the cooling elements 13 also pass through the opening 14 into the cavity 25 of the access module 28. Contrary to the access module 18 of FIG. 1, the access module 28 shown in FIG. 2 comprises a walkable area 22 or respectively a floor cover 22 that is configured as a ramp. At least a section of the flat extension of at least one flow baffle 27 is also arranged at a parallel distance to the walkable area 22 in cavity 25 of the access module 28. Furthermore, a blower 29 is arranged in the cavity 25 which circulates the air in the cavity 25 and thus assists with the thermal energy transfer from the cooling elements 13 to the walkable area 22. The remaining parts provided with reference numbers have already been described in connection with FIG. 1.

Figure 3:
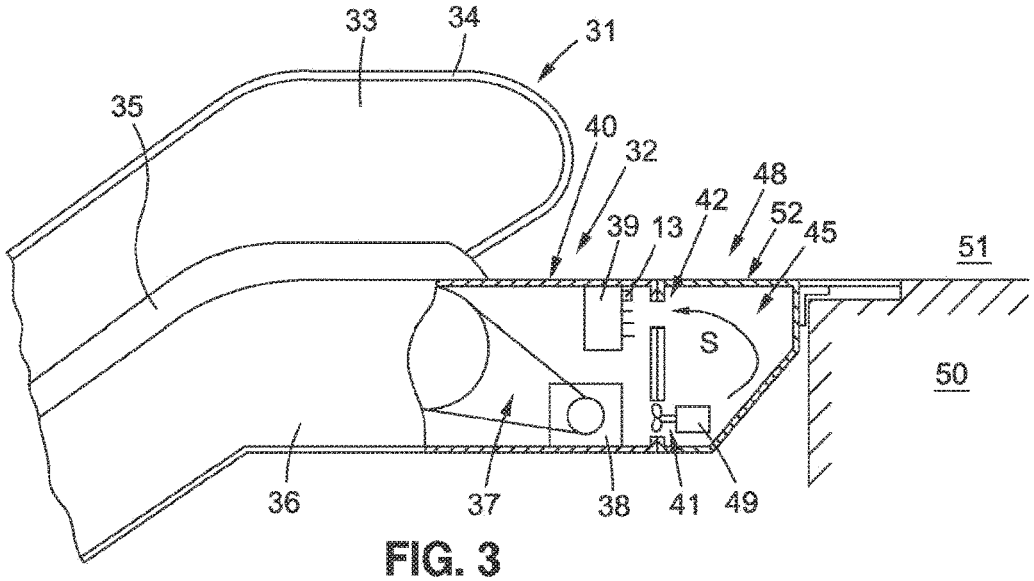
FIG. 3: A third embodiment is schematically illustrated in a partially cut layout part of a moving walkway with a component compartment and with a walkable access module, which is arranged adjacent to the component compartment.

FIG. 3 shows, schematically, a third embodiment of an access area 32 in a partially cut layout part of an escalator 31 supported by the floor 50 of a level 51 of a building. The escalator 31 can be entered and/or exited through the access area 32. Furthermore, the escalator 31 comprises two balustrades 33 (only one visible) wherein a revolving hand rail 34 is arranged on each balustrade 33. The balustrades 33 are each affixed to a bearing structure 36 of the escalator 31 by means of a balustrade base 35. This bearing structure 31 also comprises a component compartment 37 in which the components generating thermal losses 38, 39 such as a drive motor 38, a controller 39, and in particular a frequency converter or inverter are arranged below a walkable cover 40. Furthermore, the escalator 31 comprises a walkable access module 48, which is arranged adjacent to the component compartment 37.

The other end of the escalator 31 is also essentially built the same wherein there, instead of the drive motor 38, a clamping device for a step band (not shown) driven by the drive motor 38 can be arranged in the component compartment 37. Components generating thermal losses 39 such as, for example, a redundant controller 39 may, of course, be arranged there as well, as it is disclosed, for example, in EP 1 777 192 B1. At this end as well, the moving walkway 31 may have a walkable access module 48 which is adjacently arranged to the component compartment 37.

The access module 48 comprises a cavity 45. An air exchange takes place between the component compartment 37 and the cavity 45 such that the air heated by the components generating thermal losses 38, 39 can flow from the component compartment 37 through at least one opening 41 into the cavity 45, and cooler air from the cavity 45 can flow from the cavity 45 through at least another opening 42 into the component compartment 37. To support the air flow S of this air exchange, the air flowing through the openings 41, 42 can be supported by means of at least one blower 49 arranged in the access module 48. Since the walkable cover 40 of the access area 32 of the escalator 31 is arranged on the same horizontal level as the adjacent floor 50 of the building, the access module 48 comprises a level, horizontally arranged, walkable area 52 or respectively floor cover 52.

Because the access module 48 is arranged between the floor 50 and the bearing structure 36 or respectively the framework 36, it must have a sufficiently stable, supporting structure. Preferably, this stable, supporting structure (not shown) is formed as framework and arranged in the cavity 45.

Figure 4:
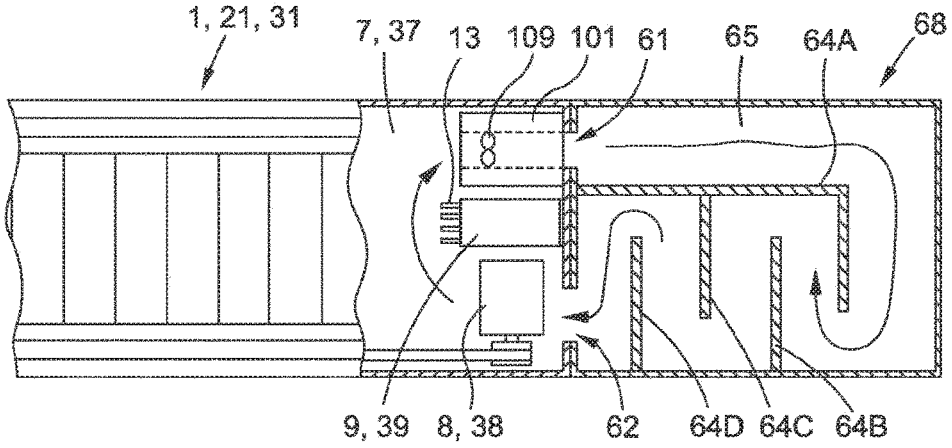
FIG. 4: A fourth embodiment is schematically illustrated in a partially cut layout part of an escalator or a moving walkway with a component compartment and with a walkable access module, which is arranged adjacent to the component compartment.
Figure 5:
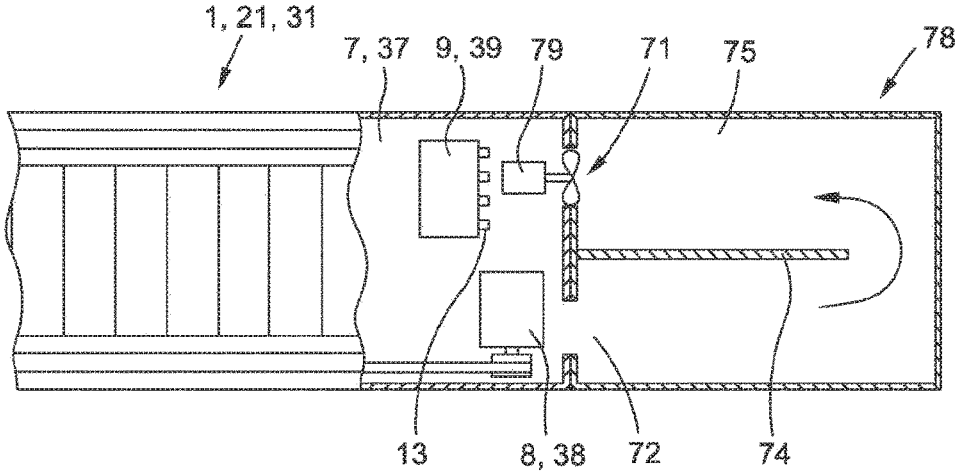
FIG. 5: A fifth embodiment is schematically illustrated in a partially cut layout part of an escalator or a moving walkway with a component compartment and with a walkable access module, which is arranged adjacent to the component compartment.
Figure 6:
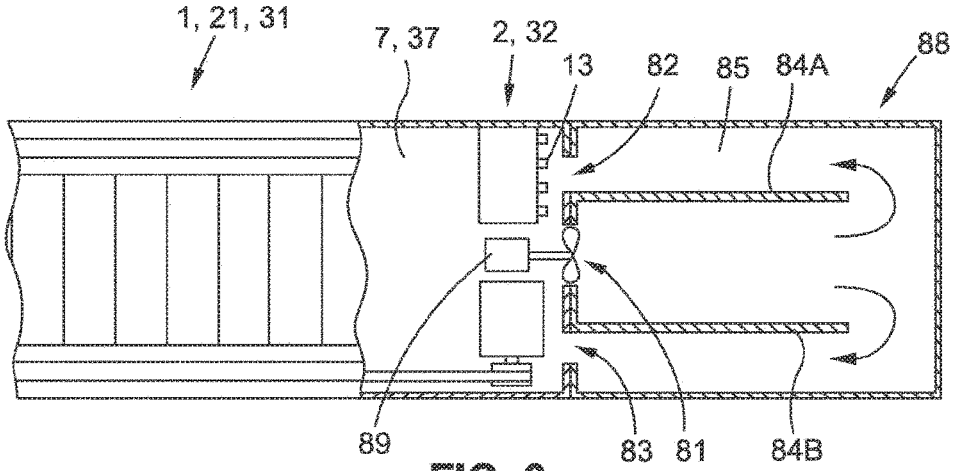
FIG. 6: A sixth embodiment is schematically illustrated in a partially cut layout part of an escalator or a moving walkway with a component compartment and with a walkable access module, which is arranged adjacent to the component compartment.

FIGS. 4 to 6 described below all show, schematically, a partially cut layout a part of the moving walkway 1, 21 or an escalator 31 with a component room 7, 37 and with a walkable access module 68, 78, 88. These access modules 68, 78, 88 can therefore be used with the escalator 31 according to FIG. 3 as well as the moving walkway 1, 21 of FIGS. 1 and 2, which is why the components shown in FIGS. 4 to 6 are provided with the same reference numbers, provided they correspond to the components described in FIGS. 1 to 3.

In FIG. 4, the components generating thermal losses 8, 9, 38, 39, 101 arranged in the component compartment 7, 37 comprise a frequency converter 101 or an inverter 101 commercially available on the market. These commercially available components usually have a blower 109 arranged in the frequency converter 101 or the inverter 101. Since the exhaust opening of the blower 109 of the frequency converter 101 is arranged flush against a first opening 61, the cooling air of this component generating lost air 101 is conveyed directly through the opening 61 into the cavity 65 of the walkable access module 68. To guide the cooling air in the cavity 65 of the walkable access module 68, several flow baffles 64A to 64D are arranged in the cavity 65. To ensure that the cooling air can be guided as much as possible along the entire bottom side of the walkable area (not shown due to the chosen section plane), so that it can transfer its thermal energy as efficiently as possible to the walkable area, the flow baffles 64A to 64D shown in the fourth embodiment are arranged in the cavity 65 in a meandering pattern and with its flat extension vertical to the walkable area. The cooled air is guided through the flow baffles 64A to 64D and flow towards a second opening 62 through which it can get to the component compartment 7, 37.

In contrast with FIG. 4, FIG. 5 shows a fifth embodiment of a walkable access module 78 in which only a vertical flow baffle 74 is arranged in the cavity 75 of the walkable access module 78. A blower 79 is arranged in the area of a first opening 71 in the component room 7, 37. The air cooled by the walkable access module 78 is suctioned. A second opening 72 is arranged so that the air flowing from the cavity 75 to the component compartment 7, 37 flows around the drive motor 8, 38.

FIG. 6 shows a sixth embodiment of a walkable access module 88, which is arranged adjacent to the component compartment 7, 37 of the escalator 31 or the moving walkway 1, 21. In this embodiment, there are three openings 81, 82, 83, wherein a blower 89 is arranged corresponding with the first opening 81. The blower 89 is arranged in the component compartment 7, 37 or respectively in the access area 2, 32 below the walkable cover, which is not shown. The cooling air flow generated by this blower 89 is divided in the cavity 85 of the walkable access module 88 by means of two flow baffles 84A, 84B wherein one half of the cooling air flow is guided to the second opening 82 and the other half of the cooling air flow to the third opening 83.

Although the invention has been described by showing specific exemplary embodiments, it is obvious that numerous other embodiment variants can be created with the knowledge of the present invention, for example, by combining the features of the individual embodiments with one another and/or exchanging individual functional units of the embodiments. One possible combination of the embodiments depicted in FIGS. 1 to 6 would result, for instance, if flow baffles were arranged both vertically and horizontally to the walkable area in the cavity. Of course, flow baffles can be arranged in the component compartment as well. Furthermore, the moving walkway can also be inserted in a pit of a structure, and its access modules can comprise a walkable area configured as stairs or a ramp.

In addition, it is possible to use more than one blower in all of the exemplary embodiments. For the sake of better overview, a depiction of drive units, step bands, pallet bands, signal transmitting means, power supply lines, and the like was largely forgone in FIGS. 1 to 6. These would, however, necessarily need to be provided so that the escalator or the moving walkway can be used properly. Consequently, correspondingly configured escalators and moving walkways are covered by the scope of protection of the present claims.

The invention claimed is:

1. An escalator or moving walkway comprising:

two access areas by which the escalator or the moving walkway can be entered or respectively exited;

components generating thermal losses arranged in at least one of the access areas in a component compartment below a walkable cover;

at least one walkable access module, which is arranged adjacent to the component compartment on an outside side of the component compartment;

wherein the walkable access module has a walkable area and a cavity, and wherein at least one opening is present between the component compartment and the cavity through which the thermal energy of the components generating thermal losses can be transferred from the component compartment to the cavity.

2. The escalator or moving walkway according to claim 1, wherein the walkable area of the access module comprises heat-conducting material and the walkable area is the ceiling of the cavity.

3. The escalator or moving walkway according to claim 1, wherein at least some of the components generating thermal losses comprise cooling elements, wherein the cooling elements pass through the at least one opening and protrude into the cavity.

4. The escalator or moving walkway according to claim 3, wherein a cross section of the at least one opening is adapted to a cross section of the cooling elements so that the at least one opening is closed by the cooling elements that pass through it.

5. The escalator or moving walkway according to claim 3, wherein the air present in the cavity and serving as a transport medium of the thermal energy between the cooling elements and the walkable area can be conveyed by at least one blower arranged in the access module.

6. The escalator or moving walkway according to claim 1, wherein an air exchange takes place between the component compartment and the cavity by an air flow which is created because air heated by components generating thermal losses flows into the cavity from the component compartment through at least one opening, and cooler air flows from the cavity into the component compartment through at least one other opening.

7. The escalator or moving walkway according to claim 6, wherein the air flowing through the opening can be conveyed by at least one blower arranged in the access module.

8. The escalator or moving walkway according to claim 6, wherein the air flowing through the opening is conveyed by means of a blower arranged in the access area below the walkable cover.

9. The escalator or moving walkway according to claim 6, wherein the components generating thermal losses comprise a frequency converter or a frequency inverter, and the air flowing through the opening can be conveyed by at least one blower arranged in the frequency converter or the frequency inverter.

10. The escalator or moving walkway according to claim 1, wherein at least one flow baffle is arranged in the cavity of the access module.

11. The escalator or moving walkway according to claim 10, wherein at least a section of a flat extension of the at least one flow baffle is arranged at a parallel distance to the walkable area.

12. The escalator or moving walkway according to claim 11, wherein the flat extension of the at least one flow baffle is arranged vertically relative to the movable area.

13. The escalator or moving walkway according to claim 1, wherein the walkable area of the at least one walkable access module is designed as a ramp or stairs.

14. A method for modernizing an existing escalator or an existing moving walkway, wherein the existing escalator or the existing moving walkway is provided with at least one walkable access module that is adjacent to a component compartment of the existing escalator or the existing moving walkway on an outside side of the component compartment, and that the at least one walkable access module comprises a walkable area and a cavity, wherein at least one opening is created between the component compartment and the cavity, through which thermal energy of components generating thermal losses can be transferred from the component compartment to the cavity.

15. The escalator or moving walkway according to claim 2, wherein at least some of the components generating thermal losses comprise cooling elements, wherein the cooling elements pass through the at least one opening and protrude into the cavity.

16. The escalator or moving walkway according to claim 4, wherein the air present in the cavity and serving as a transport medium of the thermal energy between the cooling elements and the walkable area can be conveyed by at least one blower arranged in the access module.

17. The escalator or moving walkway according to claim 7, wherein the air flowing through the opening is conveyed by means of a blower arranged in the access area below the walkable cover.

18. The escalator or moving walkway according to claim 7, wherein the components generating thermal losses comprise a frequency converter or a frequency inverter, and the air flowing through the opening can be conveyed by at least one blower arranged in the frequency converter or the frequency inverter.

19. The escalator or moving walkway according to claim 8, wherein the components generating thermal losses comprise a frequency converter or a frequency inverter, and the air flowing through the opening can be conveyed by at least one blower arranged in the frequency converter or the frequency inverter.

* * * * *